United States Patent [19]

Butler

[11] 4,172,560

[45] Oct. 30, 1979

[54] REPLACEABLE LINER FOR THE DISCHARGE ASSEMBLY OF A ROTARY GRINDING MILL OR THE LIKE

[75] Inventor: William J. Butler, Duluth, Minn.

[73] Assignee: Vermillion Equipment & Supply Co., Inc., Hibbing, Minn.

[21] Appl. No.: 886,092

[22] Filed: Mar. 13, 1978

[51] Int. Cl.[2] ..... B02C 17/18

[52] U.S. Cl. ..... 241/171; 241/70

[58] Field of Search ..... 241/70, 71, 79.2, 79.3, 241/171, 179, 181

[56] References Cited

U.S. PATENT DOCUMENTS

| | | | |
|---|---|---|---|
| 3,144,212 | 8/1964 | Klouers | 241/70 |
| 3,599,882 | 8/1971 | Sabaski et al. | 241/70 |
| 3,739,993 | 6/1973 | Nelson et al. | 241/70 |
| 3,758,041 | 9/1973 | Olson et al. | 241/171 X |
| 3,776,477 | 12/1973 | Hansen et al. | 241/179 |

*Primary Examiner*—Howard N. Goldberg
*Attorney, Agent, or Firm*—Wicks & Nemer

[57] ABSTRACT

Replaceable liner for the discharge assembly of a rotary grinding mill or the like is disclosed, in the preferred embodiment, as including first and second, self-supporting box members. The first box member includes closed sides, bottom, and second end, and includes an open top and first end. The second box member includes closed sides, top, and bottom, and includes open ends. When the grate is removed from the first discharge casting, the second box member can be inserted within the first discharge casting and moved into the second and third discharge castings. Then the first box member can be placed within the first discharge casting. Thus, when the grate is attached to the first discharge casting, the first and second box members will be captured within the first and second discharge castings. Reinforcing members are embedded in the box members for retaining their shape. Furthermore, the angle between the inside surfaces of the top and sides of the box members is perpendicular to increase the volume of the ground material path and for increasing wear.

12 Claims, 7 Drawing Figures

PRIOR ART Fig 2

REPLACEABLE LINER FOR THE DISCHARGE ASSEMBLY OF A ROTARY GRINDING MILL OR THE LIKE

BACKGROUND

The present invention relates generally to liners, more particularly to replaceable liners, and specifically to replaceable liners for the discharge end of a rotary grinding mill or the like.

It is well known that the discharge end of a rotary grinding mill or the like, such as shown in U.S. Pat. No. 3,599,882, is subjected to extreme abrasive wear due to the ground material passing therethrough. Discharge diaphragm assemblies formed of discharge castings, grates, and wear plates, as in U.S. Pat. No. 3,599,882, are used in grinding mills in an attempt to maximize the useful life of the machines. However, it is necessary to form the discharge diaphragm assembly out of very expensive material such as Ni-Hard iron. Furthermore, the discharge diaphragm assembly of the prior art, after being worn by the ground material, had to be removed and replaced piece by piece, which is expensive in both labor and also down time in that the grinding mill cannot be operated for significant periods during replacement of the discharge diaphragm assembly.

Thus, a need has arisen in the art for a replaceable liner for insertion into the discharge castings such that the lines can be inexpensively replaced with substantial savings in labor and down time and also allowing the discharge diaphragm assembly to be made of less costly material.

Past attempts to provide such a replaceable liner have not proven successful and have, in instances, failed to remain in place at least in view of the extremely hostile environment.

SUMMARY

The present invention solves these and other problems in rotary grinding mills or the like by providing, in the preferred embodiment, a replaceable liner for insertion into the discharge castings comprising, in combination, first and second, self-supporting box members which can be captured within the discharge castings of the rotary grinding mill.

It is thus an object of the present invention to provide a replaceable liner for insertion into the discharge casting of a rotary grinding mill or the like.

It is a further object of the present invention to provide such a novel replaceable liner which can be inexpensively replaced within the discharge castings with substantial savings in labor and down time.

It is a further object of the present invention to provide such a novel replaceable liner which may be manufactured at a low cost and which maximizes wear before replacement.

It is a further object of the present invention to provide such a novel replacement liner which does not require the piece by piece removal of the discharge castings.

It is a further object of the present invention to provide such a novel replacement liner which protects the discharge castings from abrasive wear caused by the ground material passing through the discharge castings on its way out of the mill.

These and further objects and advantages of the present invention will become clearer in light of the following detailed description of an illustrative embodiment of this invention described in connection with the drawings.

DESCRIPTION OF THE DRAWINGS

The illustrative embodiments may best be described by reference to the accompanying drawings where:

FIG. 2 is a diagramatic side view of the mill of FIG. 1 according to view line 2—2 of FIG. 1, with portions of the mill broken away.

FIG. 3 is a cross sectional view of a replaceable linear according to the teachings of the present invention for use with the mill of FIG. 1 or the like.

Figure 1:
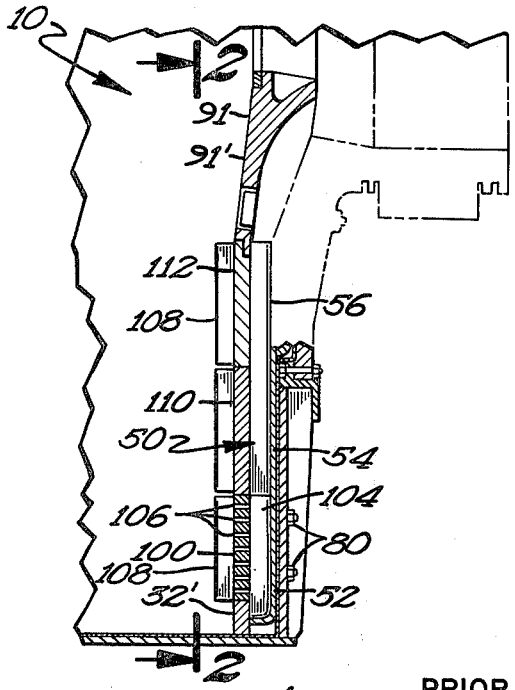
Fig 1 PRIOR ART
FIG. 1 shows a partial, diagramatic longitudinal section of a grinding mill such as is illustrated in U.S. Pat. No. 3,599,882 and having a discharge assembly.

All figures are drawn for ease of explanation of the basic teachings of the present invention only; the extensions of the figures with respect to number, position, relationship, and dimensions of the parts to form the preferred embodiment will be explained or will be obvious from the explanation given.

Where used in the various figures of the drawings, the same numeral designates the same or similar parts in the present invention. Furthermore, when the terms "right," "left," "first," "second," "top," "bottom," and similar terms are used herein, it should be understood that these terms have reference only to the structure shown in the drawings as it would appear to a person viewing the drawings and are utilized only to facilitate describing the invention.

DESCRIPTION

Referring to the drawings, a rotary grinding mill or the like is generally designated 10 and may be of the type as diagramatically shown in U.S. Pat. No. 3,599,882. Mill 10 is provided with a discharge assembly 50 including a plurality of superposed tiers of outer discharge castings 52, middle or intermediate discharge castings 54, inner discharge castings 56, and a plurality of arcuate castings 91' forming a discharge cone 91. Castings 52, 54, 56, and 91' are contiguous and extend circumferentially of mill 10. Further included are grates 100 provided with passages 106 therethrough of appropriate size, and wear plates 110 and 112. Grate 100 is attached to casting 52 by bolts 80 which pass through lifter bar 108. Wear plates 110 and 112 are attached to castings 54 and 56, respectively, in a similar manner as grate 100 is to casting 52. The castings 52, 54 and 56, grate 100, and plates 110 and 112 define a discharge chamber 104. The radially outer edge surfaces of grate 100 abut against the radially inner surface of a filler ring 32'.

In the figures, a replaceable liner according to the teachings of the present invention is shown for insertion into discharge castings 52, 54, and 56 and generally designated 200. Liner 200 includes a first box member 202 and a second box member 204.

First box member 202 includes a first closed side 206, a second closed side 208, a first open end 210, a second closed end 212, an open top 214, and a closed bottom 216. Bar 217 can be provided at the intersection of end 210 and top 214 for purposes to be explained further hereinafter. First box member 202 has a shape complementary to the shape of first discharge casting 52. Specifically, box member 202 is scooped shape or has a tube like shape. The distance between the plane of top 214 and bottom 216 increases from end 212 to end 210 to provide a flow incline for the material received therein through open end 210.

Second box member 204 includes a first closed side 218 having an inside surface 220 and an outside surface 222, a second closed side 226 having an inside surface 228 and an outside surface 230, a first open end 232, a second open end 234, a closed top 236 including an inside surface 238 and an outside surface 240, and a bottom 242 including an inside surface 244 and an outside surface 246. Second box member 204 has a shape complementary to the shape of second and third discharge castings 54 and 56, and when grate 100 is removed, allowing insertion within first discharge casting 52 and into second and third discharge castings 54 and 56. Specifically, box 204 is tube shaped, wedged shaped, or has a shape like a tapered box-section open at both ends.

It should then be noted that first and second sides 218 and 226 taper towards each other from end 234 to end 232. Furthermore, outside surfaces 222 and 230 of sides 218 and 226, respectively, taper towards each other from top 236 to bottom 242. This tapering of sides 218 and 216 conforms to the shape of discharge castings 54 and 56 and thus allows box member 204 to be inserted into castings 54 and 56.

Inside surfaces 238 and 244 of top 236 and bottom 242 of box member 204 are parallel for preventing concentration of the ground material path therein. The angle of the corners 248 and 250 formed between inside surface 238 of top 236 and inside surfaces 220 and 228 of sides 218 and 226, respectively, are approximately 90° or perpendicular for increasing the volume of the ground material path as will be explained further hereinafter. Top 236 has a thickness greater than the thickness of bottom 242, again for purposes as will also be explained further hereinafter.

After grate 100 has been removed from casting 52, box member 204 can be inserted within casting 52 and into castings 54 and 56. It can then be appreciated that box member 204 is captured between castings 54 and 56 and wear plates 110 and 112 and is prevented from moving in a first direction, radially inward, due to its wedged or tapered shape complementary to the shape of castings 54 and 56. When box member 204 is located in castings 54 and 56, box member 202 can be placed within castings 52 thus abutting with box member 204 and preventing movement of member 204 in a second direction, radially outward. Box member 202 is captured between the casting 52 and grate 100 when grate 100 is operatively attached to casting 52. Box members 202 and 204 are then removably captured within discharge castings 52, 54, and 56 when grate 100 is attached to discharge casting 52. Thus, it should be noted that box member 202 holds member 204 and castings 54 and 56 and grate 100 hold box member 202 in casting 52. Furthermore, it should be noted that end 212 of box member 202 abuts with filler ring 32' in the preferred embodiment. Additionally, it should be noted that end 210 of box member 202 is of the same dimensions as end 234 of box member 204 and abuts therewith when box members 202 and 204 are positioned within castings 52, 54 and 56.

Figure 3:
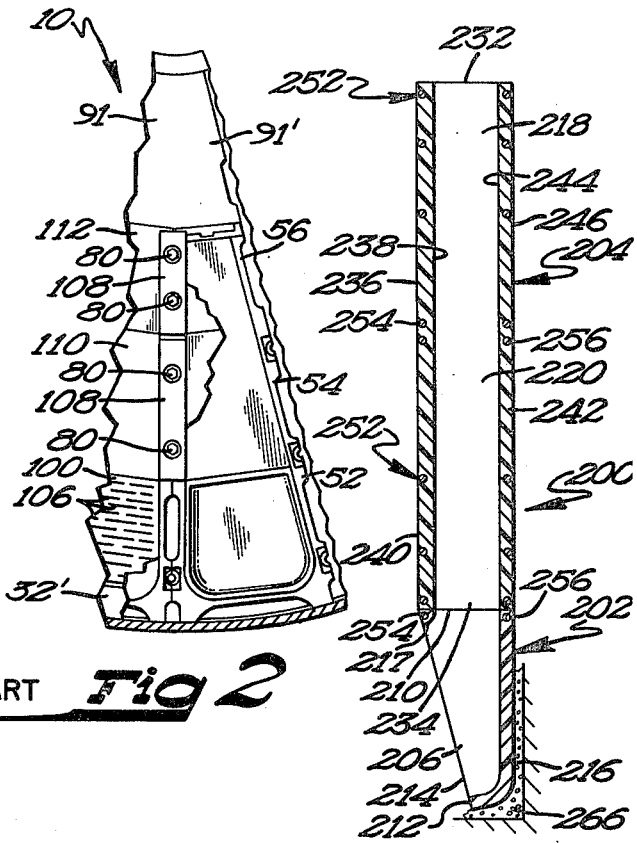
Figure 5:
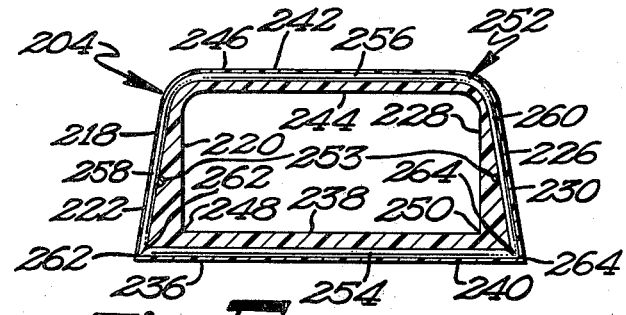
FIG. 5 is a cross sectional view of the liner of FIG. 4 according to section line 5—5 of FIG. 4.
Figure 6:
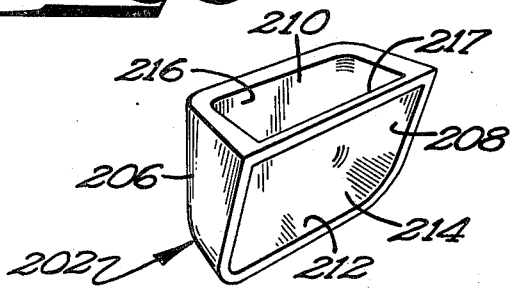
FIG. 6 is a perspective view of a part of the liner of FIG. 3.

It should be noted that, in FIG. 3, open top 214 is beveled, rather than flat as diagramatically shown in FIG. 1. The liner 200 in FIG. 3 is shown as actually manufactured for an actual rotary grinding mill and abuts against grate 100 in its normal installation.

Box members 202 and 204 should be formed of material which has high resistance to abrasion allowing long wear life and which lends to easy replacement. According to the teachings of the present invention, urethane has been found to be such a material and to wear better than metallic material in this extremely hostile environment.

Box members 202 and 204 should also be formed such that they are also self-supporting. Specifically, box sections 202 and 204 must have their own structural integrity so that they do not depend on any other piece for strength or continuity. If box members 202 and 204 are not self-supporting such that they do not retain their shape, ground material will flow between box sections 202 and 204 and castings 52, 54, and 56, grate 100, and wear plates 110 and 112. If this occurs, the box sections collapse and move down and clog up the discharge chamber, making the grinding mill inoperative. Material, such as rubber, which has been tried by adhering it or gluing it to the sides of castings 52, 54, and 56, grate 100, or wear plates 110 and 112, was found to loosen therefrom during the normal operation and suffer from this severe disadvantage. According to the present invention, urethane, as disclosed herein, is such a self-supporting material and overcomes this disadvantage.

Box members 202 and 204 are subjected to tremendous forces which could deform their shape in the normal operation of mill 10 and also due to the torque created by tightening bolts 80 attaching grate 100 and wear plates 110 and 112 to castings 52, 54, and 56. To futher retain the shape of box members 202 and 204 to prevent distortion thereof, reinforcing members 252 may be embedded in box members 202 ad 204.

Ring shaped reinforcing members 252 include a top member 254 embedded in top 236, a bottom member 256 embedded in bottom 242, and first and second side members 258 and 260 embedded in sides 218 and 226, respectively. Members 252 have a shape corresponding to the shape of outside surfaces 222, 230, 240, and 246 of box member 204. The angle of corners 262 and 264 formed between top member 254 and first and second side members 258 and 260, repsectively, is approximately 85° such that side members 258 and 260 follow the taper of sides 218 and 226 from top 236 to bottom 242. It should then be noted that member 252 is embedded within member 204 as close to outside surfaces 222, 230, 240, and 246 as possible and is spaced as much as possible from corners 248 and 250 for allowing maximum wear of box member 204 before exposing reinforcing member 252.

Several members 252 are provided parallel to each other in member 204 at desired spacings along its length. It should then be noted that the size of members 252 decrease from end 254 to end 232 to correspond to the taper of member 204. It should also be noted that longitudinal reinforcing members 253 can be provided to hold members 252 in place while forming member 204.

Furthermore, members 252 may be provided in box member 202. Specifically, top member 254 can be embedded in bar 217, bottom member 256 can be embedded in bottom member 216, and first and second side members 258 and 260 can be embedded in first and second sides 206 and 208, respectively.

To further prevent material from flowing within any voids between box members 202 and 204 and discharge castings 52, 54, and 56, grate 100, and wear plates 100 and 112, material 266 can be located therein. Specifically, a hardenable material 266 is injected into any such void and hardened therein. According to the teachings of the present invention, urethane foam is such a material and thus prevents ground material from flowing into the voids.

A subtle feature of the present invention may now be explained. Due to the rotation of the rotary grinding mill or the like, the ground material passing through the discharge assembly is subjected to centrifugal force. Thus, the ground material will seek the area of the largest radius which will be corners 248 or 250, depending upon the direction of rotation. Thus, the material concentrates in a volume approximately four inches inward of the top 236 and four inches on side 218 or 226. Thus, due to the perpendicular angle of corners 248 and 250, the volume of the ground material path is increased without less abrasive surface exposure than if corners 248 and 250 were rounded such as would be normal in the art and as are corners between bottom 242 and sides 218 and 226.

Another subtle feature of the present invention can now also be explained. The area of greatest abrasion is along corners 248 and 250 since the ground material is concentrated therealong. According to the present invention, top 236 is of additional thickness and sides 218 and 226 has a greater thickness due to the taper of outside surfaces 222 and 230 from top 236 to bottom 242 and the perpendicular angle of corners 248 and 250. Due to this increased thickness, more material is provided to wear away because of abrasion and thus the length of use of member 204 is increased.

Further, when reinforcing members 252 are exposed to the ground material, the ground material begins to abrasively wear around members 252 thus quickly wearing through members 202 and 204. Since side members 258 and 260 of members 252 follow the taper of sides 218 and 236 from top 236 to bottom 242 and can thus be embedded close to outside surfaces 222, 230, 240, and 246 as possible and can be spaced as much as possible from corners 248 and 250, the present invention allows maximum wear of box member 204 before exposing reinforcing members 252 and thus also increasing the length of use of box members 204.

Figure 7:
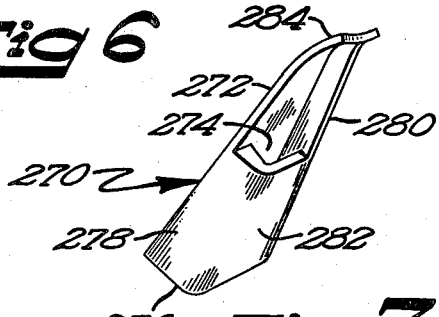
FIG. 7 is a partial view of an additional piece forming an alternate embodiment of the liner of FIG. 3.
Figure 4:
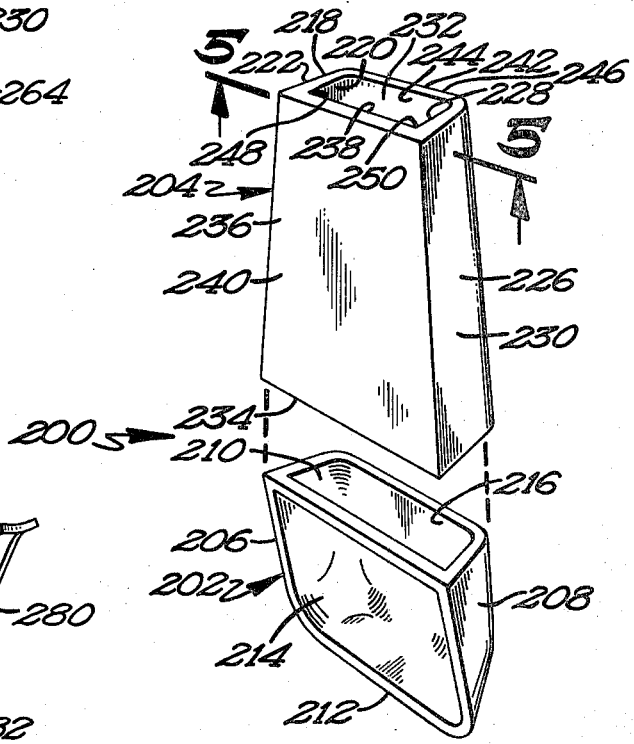
FIG. 4 is an exploded perspective view of the liner of FIG. 3.

Box members 202 and 204 are installed in the outer most three of the discharge castings 52, 54, and 56. The same principal may be used to provide similar liners for the three inner most castings 91'. However, an inner most box member 270 of the liner may include a discharge outlet having an open bottom and closed top for discharging the ground material in a direction opposite the inlet to grate 100, as best seen in FIG. 7. Specifically, box member 270 includes a top 272, a first open end 274, a second open end 276, a first side 278, a second side 280, and a bottom 282. Top 272 generally extends beyond open end 274 and terminates in a curved portion 284 which follows and protects castings 91'. It should then be noted that one of the sides 278 or 280 also extends beyond end 274 and terminates in curved portion 284 of top 272, such as side 280 in FIG. 7. It should then be noted that sides 278 or 280 extend past end 274 alternately such that in mill 10, members 270 in adjacent tiers of castings 52, 54, and 56 form a unitary outlet.

Discharge assemblies of a rotary grinding mill or the like prior to the present invention were formed of Ni-Hard iron which is relatively expensive. Since liner 200 of the present invention protects the castings from abrasive wear caused by the ground material passing through the discharge castings on its way out of the mill, the discharge assembly could be made of mild steel and thus reducing the cost of material for manufacture of the mill.

After the present invention has been thus explained, the substantial savings in both cost of materials and installation labor can be appreciated. Specifically, it is not necessary to take out and replace the discharge assembly piece by piece which is costly not only in labor but also in down time, but rather to simply remove grate 100 from castings 52 and remove and replace liner 200 of the present invention at a low cost in both labor and down time, without replacing the discharge assembly as was necessary in the past.

Now that the basic teachings of the present invention have been explained, many extensions and variations will be obvious to one having ordinary skill in the art. The number and shape of the discharge castings may vary according to type and manufacturer of the rotary grinding mill. It would be within the skill of the art after the teachings of the present invention to include further box members similarly corresponding to the number and shape of the discharge castings.

Thus, since the invention disclosed herein may be embodied in other specific forms without departing from the spirit or the general characterists thereof, some of which forms have been indicated, the embodiments described herein are to be considered in all respects illustrative and not restrictive. The scope of the invention is indicated by the appended claims, rather than by the foregoing description, and all changes that come within the meaning and range of equivalency of the claims are intended to be embraced herein.

What is claimed is:

1. In a discharge assembly adapted to be mounted inside the discharge end of a rotary grinding mill or the like comprising at least first and second contiguous discharge castings extending circumferencially of the grinding mill or the like, with the first discharge casting including a grate provided with passages and the second discharge casting including a wear plate, with the first and second discharge castings, the grate, and the wear plate defining a discharge chamber, the improvement comprising replaceable liner for insertion into the discharge castings, comprising, in combination: at least first and second, self-supporting box members; with the first box member including a first closed side, a second closed side, a first open end, a second closed end, an open top, and a closed bottom; with the second box member including a first closed side having an inside surface and an outside surface, a second closed side having an inside surface and an outside surface, a first open end, a second open end, a closed top having an inside surface and an outside surface, and a closed bottom having an inside surface and an outside surface; with the second box member having a shape complementary to the shape of the second discharge casting, allowing insertion within the first discharge casting when the grate is removed and into the second discharge casting, and preventing movement of the second box member in the second discharge casting in a first direction, and the first box member having a shape complementary to the first discharge casting, allowing placement within the first discharge casting and preventing movement of the second box member in the second discharge casting in a second direction, for capturing the first and second box members within the first and second discharge castings when the grate is attached to the first discharge casting.

2. The replaceable liner of claim 1 wherein the angle of the corners formed between the inside surface of the top and the inside surfaces of the first and second sides of the second box member is approximately 90° for increasing the volume of the ground material path.

3. The replaceable liner of claim 2 further comprising reinforcing members embedded in the top, bottom, and first and second sides of the box members for retaining the shape of the box members to prevent distortion thereof when captured within the first and second discharge castings.

4. The replaceable liner of claim 3 wherein the reinforcing members in the second box member include a top member embedded in the top of the box member, first and second side members embedded in the first and second sides of the box member, and a bottom member embedded in the bottom of the box member, with the reinforcing members having a shape corresponding to the shae of the outside sufaces of the top, bottom, and first and second sides of the box member, and the reinforcing member being located as close to the outside surfaces of the top, bottom, and first and second sides of the box member and spaced as much as possible from the corners formed between the inside surface of the top and the inside surfaces of the first and second sides of the box member for allowing the maximum wear of the box member before exposing the reinforcing member.

5. The replaceable liner of claim 1 wherein the inside surfaces of the top and bottom of the second box member are parallel for preventing concentration of the ground material path therebetween.

6. The replaceable liner of claim 1 wherein the box members are formed of urethane.

7. The replaceable liner of claim 1 further comprising material located within any voids between the box members and the discharge castings which can be injected and hardened therein to prevent the material from flowing into the voids.

8. The replaceable liner of claim 7 wherein the material is urethane foam.

9. The replaceable liner of claim 1 wherein the top of the second box member has a thickness greater than the bottom of the second box member.

10. The replaceable liner of claim 1 further comprising reinforcing members embedded on the top, bottom, and first and second sides of the box members to prevent distortion thereof when captured within the first and second discharge castings.

11. The replaceable liner of claim 10 wherein the reinforcing members in the second box member incude a top member embedded in the top of the box member, first and second side members embedded in the first and second sides of the box member, and a bottom member embedded in the bottom of the box member, with the reinforcing members having a shape corresponding to the shape of the outside surfaces of the top, bottom, and first and second sides of the box member and the reinforcing member being located as close to the outside surfaces of the top, bottom, and first and second sides of the box member and spaced as much as possible from the corners formed between the inside surface of the top and the inside surfaces of the first and second sides of the box member for allowing the maximum wear of the box member before exposing the reinforcing member.

12. The replaceable liner of claim 4 or 11 wherein the angle of the corners formed between the top member and the first and second side members of the reinforcing members is approximately 85°.

* * * * *